US005918963A

United States Patent [19]

Churchville et al.

[11] Patent Number: 5,918,963

[45] Date of Patent: Jul. 6, 1999

[54] COMBINED PLATE AND CANDLE DISPLAY

[75] Inventors: Barbara Ann Churchville, Kennett Square; Allen Edward Darrone, West Chester, both of Pa.

[73] Assignee: Franklin Mint Company, Franklin Center, Pa.

[21] Appl. No.: 08/901,550

[22] Filed: Jul. 28, 1997

[51] Int. Cl.[6] ..... F21L 19/00

[52] U.S. Cl. ..... 362/161; 362/810

[58] Field of Search ..... 362/161, 806, 362/810, 132, 253; 248/371, 346.03, 473, 469

[56] References Cited

U.S. PATENT DOCUMENTS

| | | | |
|---|---|---|---|
| D. 48,746 | 3/1916 | Foster . | |
| D. 49,097 | 5/1916 | McGrane . | |
| D. 68,271 | 9/1925 | O'Connell . | |
| D. 87,211 | 6/1932 | Hague . | |
| D. 101,799 | 11/1936 | Stinson . | |
| D. 164,064 | 7/1951 | Rubel | D48/2 |
| D. 207,413 | 4/1967 | Gardner | D48/2 |
| 1,440,509 | 1/1923 | Townsend . | |
| 1,895,659 | 1/1933 | Hague . | |
| 2,422,261 | 6/1947 | Richards | 248/33 |
| 3,779,504 | 12/1973 | Schwartz et al. | 248/441 |
| 4,947,263 | 8/1990 | Leluan, Jr. | 248/473 |
| 5,264,995 | 11/1993 | McKee | 362/161 |

FOREIGN PATENT DOCUMENTS

| | | |
|---|---|---|
| 258728 | 9/1926 | United Kingdom . |

*Primary Examiner*—Sandra L. O'Shea
*Assistant Examiner*—Marshall Honeyman
*Attorney, Agent, or Firm*—Seidel, Gonda, Lavorgna & Monaco, PC

[57] ABSTRACT

A combined plate and candle display is provided having a base, a candle and a decorative plate. The base includes a top and bottom surface, as well as a front end and a back end. A recess is located on the top surface of the base adjacent to the front end and has a depth less than the thickness of the base. A support cavity is located on the top surface of the base adjacent to the back end and has a depth less than the thickness of the base. A support post is secured in a support cavity and rises from the top surface. A groove is located on the top surface of the base and has a depth less than the thickness of the base. The plate is situated on the base so that its back face rests against the support post and the edge of the plate is positioned in the groove. The candle is situated in the recess, in front of the plate.

13 Claims, 8 Drawing Sheets

COMBINED PLATE AND CANDLE DISPLAY

FIELD OF THE INVENTION

This invention relates generally to the field of display devices, and more particularly to a display for a plate and a candle, or the like.

BACKGROUND OF THE INVENTION

Decorative plates or similar articles, such as framed photographs or award plaques, are often displayed in upright, standing positions with the aid of a support.

Displays adorned with religious expression or symbolism often take on a meaningful purpose. Votives or candles are often placed around or near such displays for a devotional purpose or memorial significance. The resulting display may be the center piece of a small religious shrine, for example.

SUMMARY OF THE INVENTION

A combined plate and candle display of the present invention comprises a base having a top and bottom surface, as well as a front end and a back end. A recess is provided on the top surface of the base adjacent to the front end and has a depth less than the thickness of the base. A support post is secured to and projects from the top surface. A groove is located on the top surface of the base and has a depth less than the thickness of the base. A plate is situated on the display so that its back face rests against the support post and the edge of the plate is positioned in the groove. A candle or similar article is situated in the recess.

The base is preferably symmetrical so that the candle supported in the recess may be centered relative to the plate. The plate and candle display may be used to support or display a religious symbol, photographs, award plaques, plants, small lights or similar articles.

BRIEF DESCRIPTION OF THE DRAWINGS

For the purpose of illustrating the invention, there is shown in the drawings a form which is presently preferred; it being understood, however, that the invention is not limited to the precise arrangements and instrumentalities shown.

DETAILED DESCRIPTION OF THE INVENTION

Figure 1:
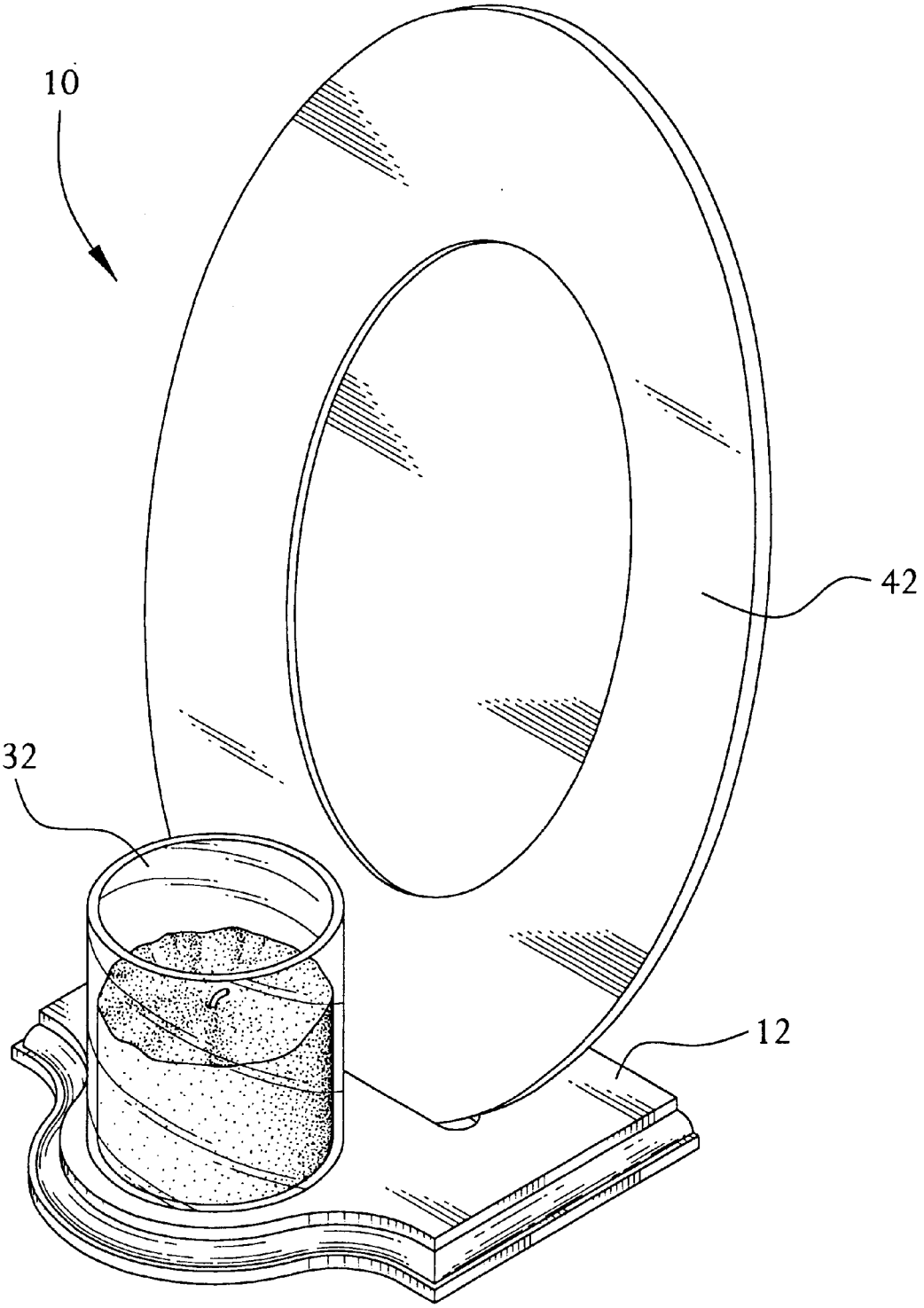
FIG. 1 is an isometric view of an embodiment of the display contemplated by the present invention.
Figure 2:
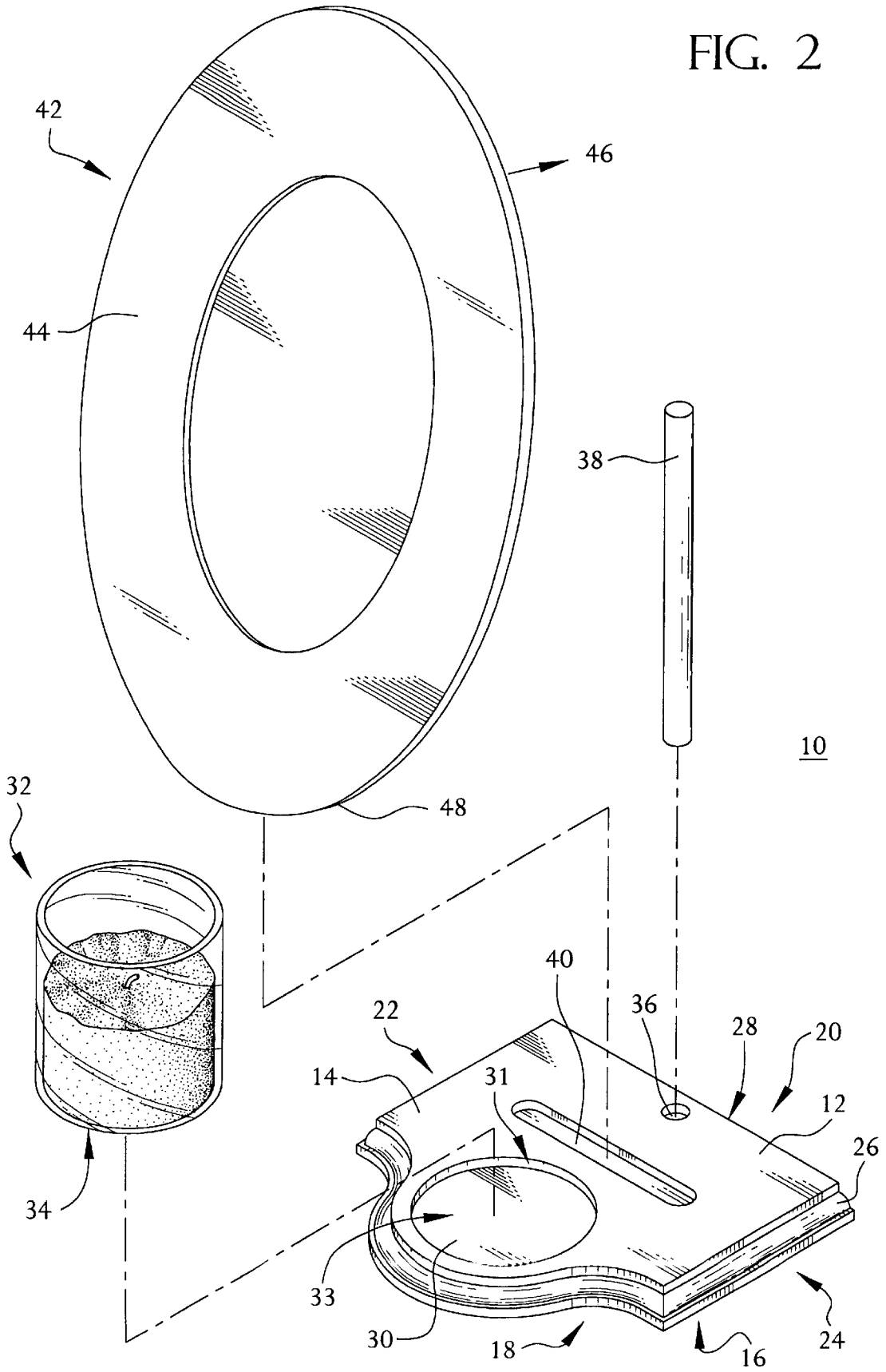
FIG. 2 is an exploded isometric view of the display of the present invention.

In the drawings, where like elements are identified by like numerals, there is shown in FIG. 1 a display which is generally referred to by the numeral 10. The display 10 comprises a generally solid base 12, a candle or votive 32, and an ornamental plate 42. As more particularly shown in FIGS. 2 and 3, the base 12 includes a top surface 14 and an opposing bottom surface 16 (see FIG. 6). The base 12 also has a front end 18 and a back end 20 joined by two sides 22, 24. The two sides 22, 24 are preferably parallel. The top surface 14 and the bottom surface 16 of the base 12 are parallel and are separated by a continuous peripheral edge 26. The base 12 is preferably about five inches in length and about four and one-half inches in width and has a thickness of about one-half inch. The continuous edge 26 may be decoratively routed. As shown, the front end 18 is curved. The back edge 28 is perpendicular to the two sides 22, 24. The base 12 preferably has a line of symmetry extending from the front end 18 to the back end 20.

The base 12 contains a recess 30 located on the top surface 14 adjacent the front end 18. The recess 30 has a depth less than the thickness of the base 12. The recess 30 is preferably one-eighth inch deep. The recess 30 is adapted to receive and retain a vessel, or as shown, the candle 32. The bottom 34 of the candle 32 is placed on the bottom surface 33 of the recess 30 and is supported thereby. The depth of the recess 30 creates a wall 31 which provides lateral support for the candle 32. The recess 30 as illustrated is circular and is slightly larger in diameter than the diameter of the candle 32. In the preferred dimensions, the recess has a diameter of about two and one-sixteenth inches. The candle need not be circular as shown in the Figures, nor is the recess 30 required to be circular.

The base 12 also contains a support cavity 36 located on the top surface 14 adjacent the back end 20. The support cavity 36 has a depth less than the thickness of the base 12. Preferably the cavity depth is in the range of about one-eighth inch to three-eighths inch. The cavity 36 is adapted to receive and retain a support post 38. The support post 38 is mounted in the cavity 36 at one end, perpendicular to the top surface 14 of the base 12. The support post 38 projects upward from the top surface 14. The support post 38, as illustrated, is a cylindrical dowel having about a five-sixteenths inch diameter, and rising about four and one-half inches above the top surface 14. The support post 38 may be non-cylindrical, such as having one or more flat sides. It is contemplated that more than one support post may be employed.

The base 12 contains an elongated groove 40 located on the top surface 14 between the recess 30 and the cavity 36. The groove 40 is adjacent the support post 38 but spaced from it. The groove 40 has a depth less than the thickness of the base 12 and is preferably about three-eighths inch deep. The groove 40 also has a width less than the width of the base 12. The groove 40 is parallel to the back edge 28 and about three-eighths inch wide and about two and three-quarter inches long.

Figure 3:
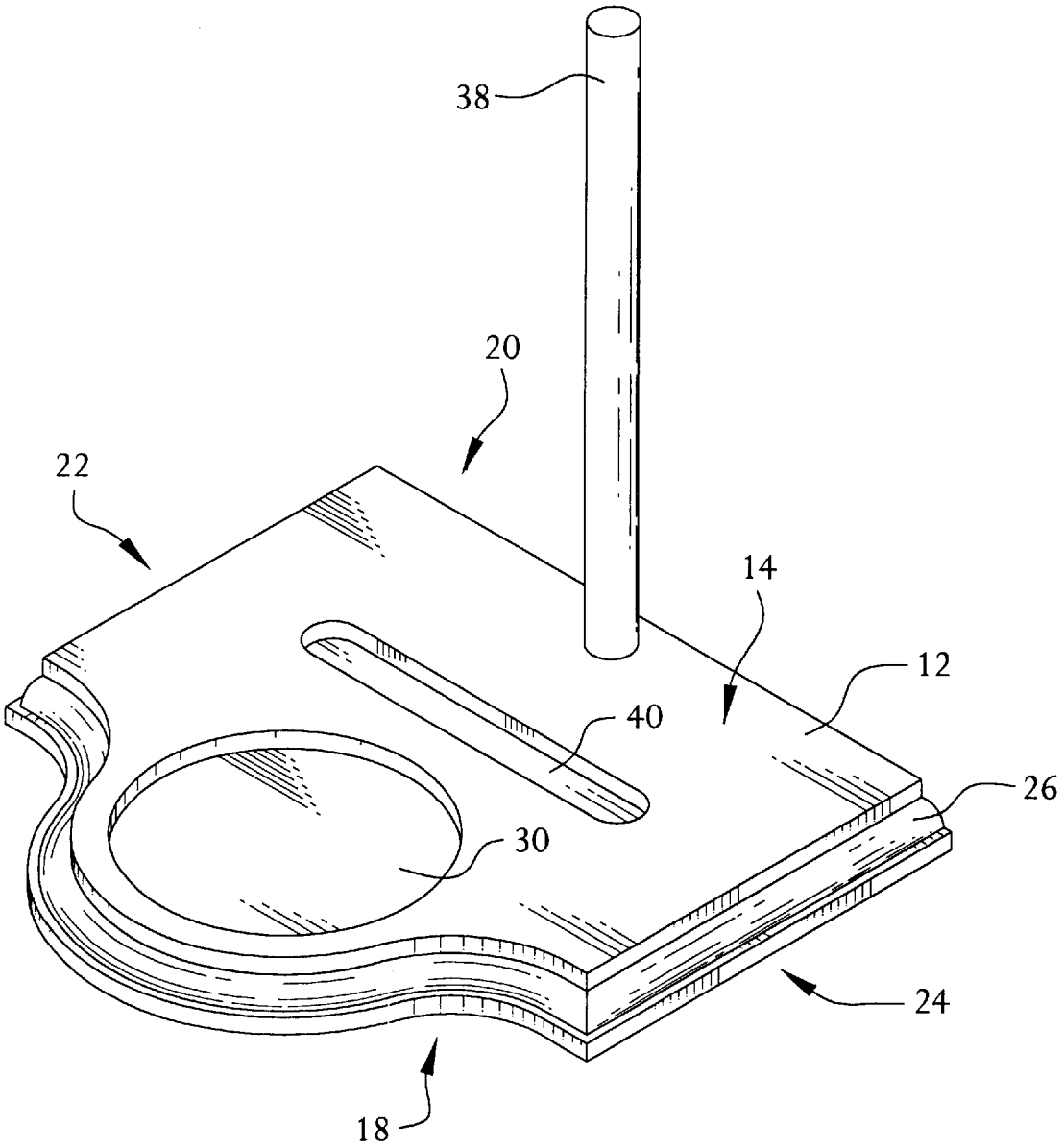
FIG. 3 is an isometric view of a display base as contemplated by the present invention.
Figure 5:
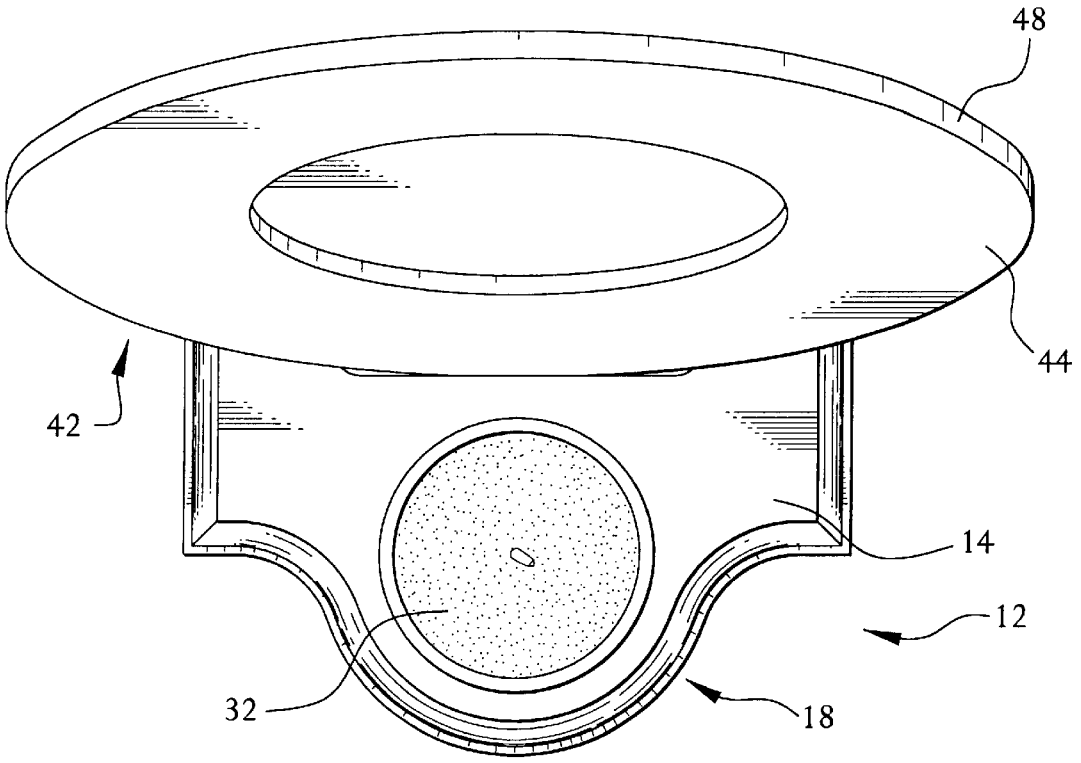
FIG. 5 is a top plan view of the display of the present invention.
Figure 6:
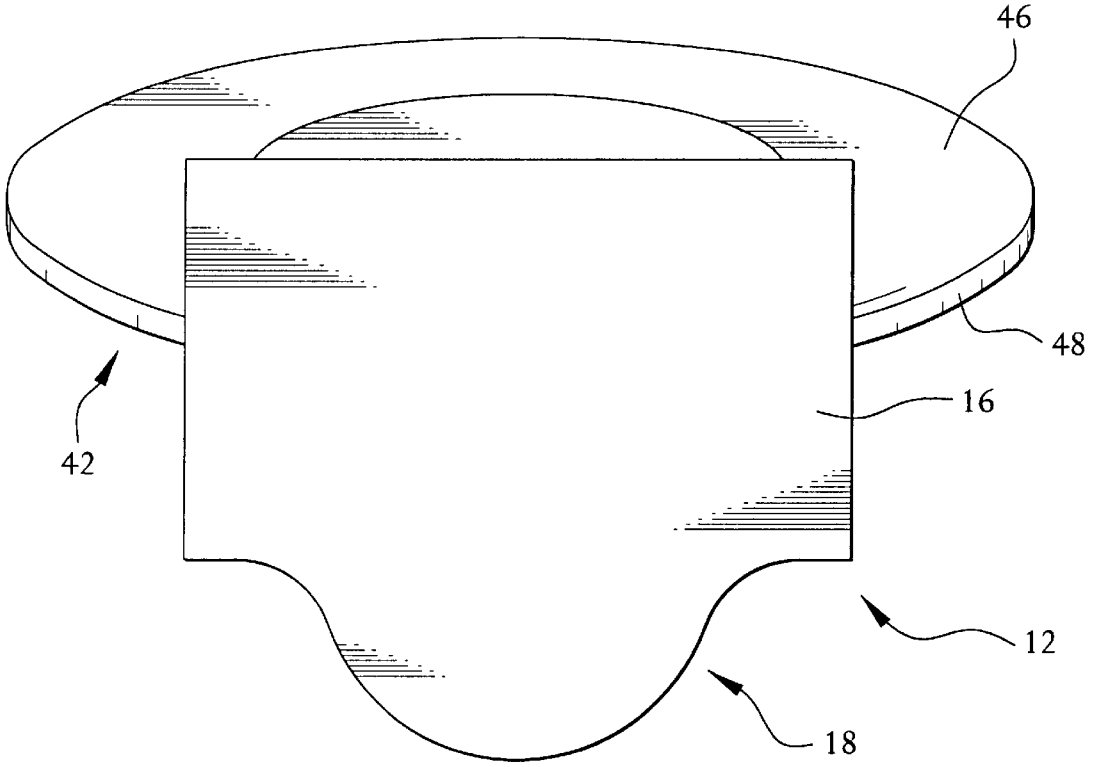
FIG. 6 is a bottom plan view of the display of the present invention.
Figure 7:
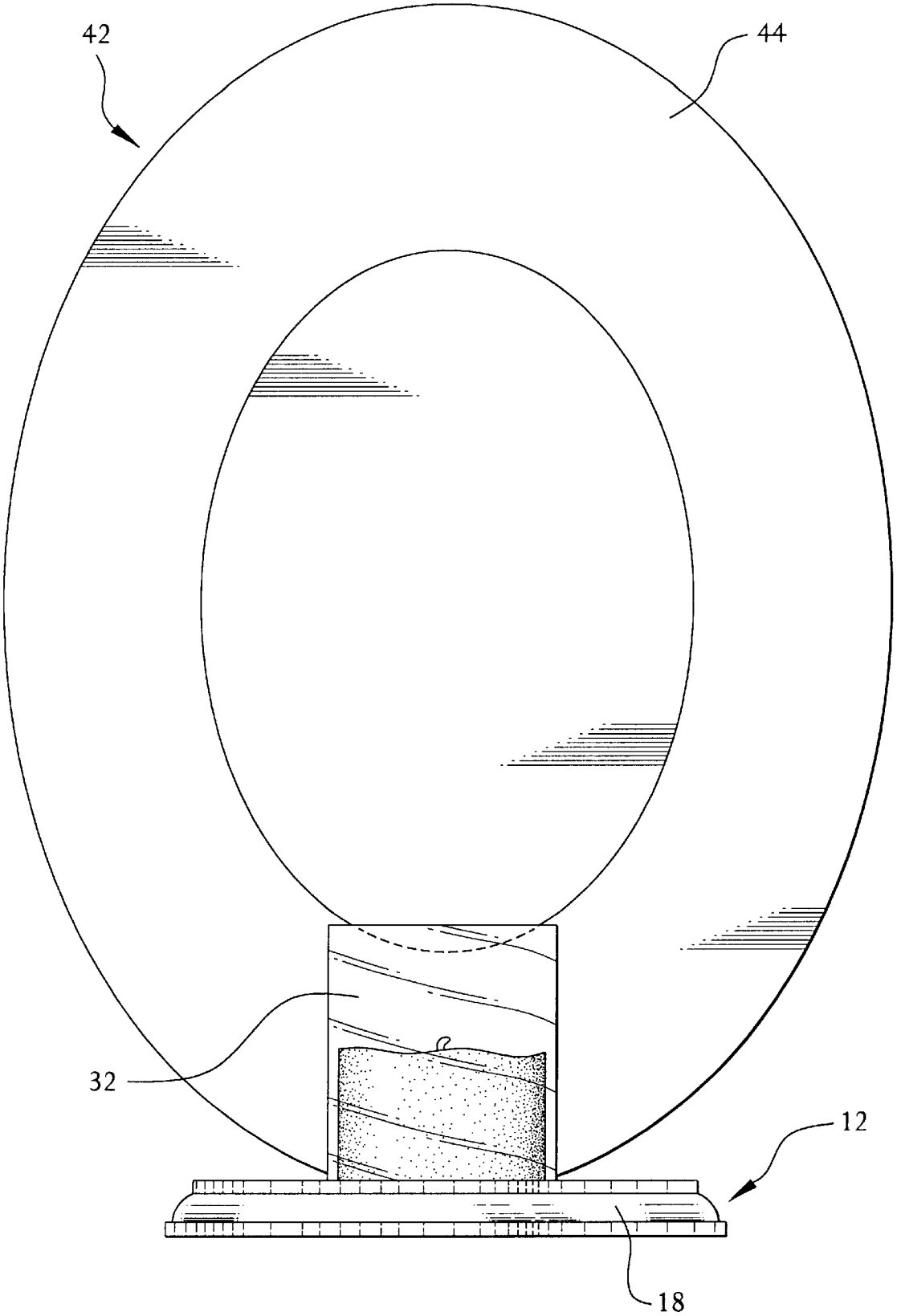
FIG. 7 is a front elevational view of the display of the present invention.

The groove 40 and post 38 are arranged to support the plate 42 or similar article. As shown in FIGS. 1, 2 and 4–8 (and in particular FIG. 4), a plate 42 having a front face 44, a back face 46, and a continuous peripheral outer edge 48 is positioned on the display 10. The groove 40 engages the edge 48 of the plate 42 and the back face 46 rests against the support post 38. As shown in FIG. 3, the groove 40 and support post 38 are positionally centered relative to each other. The support post 38 acts as a brace against the center of the plate 42. The supported plate 42 is centered relative to the candle 32, as shown in FIGS. 5 and 7.

Figure 4:
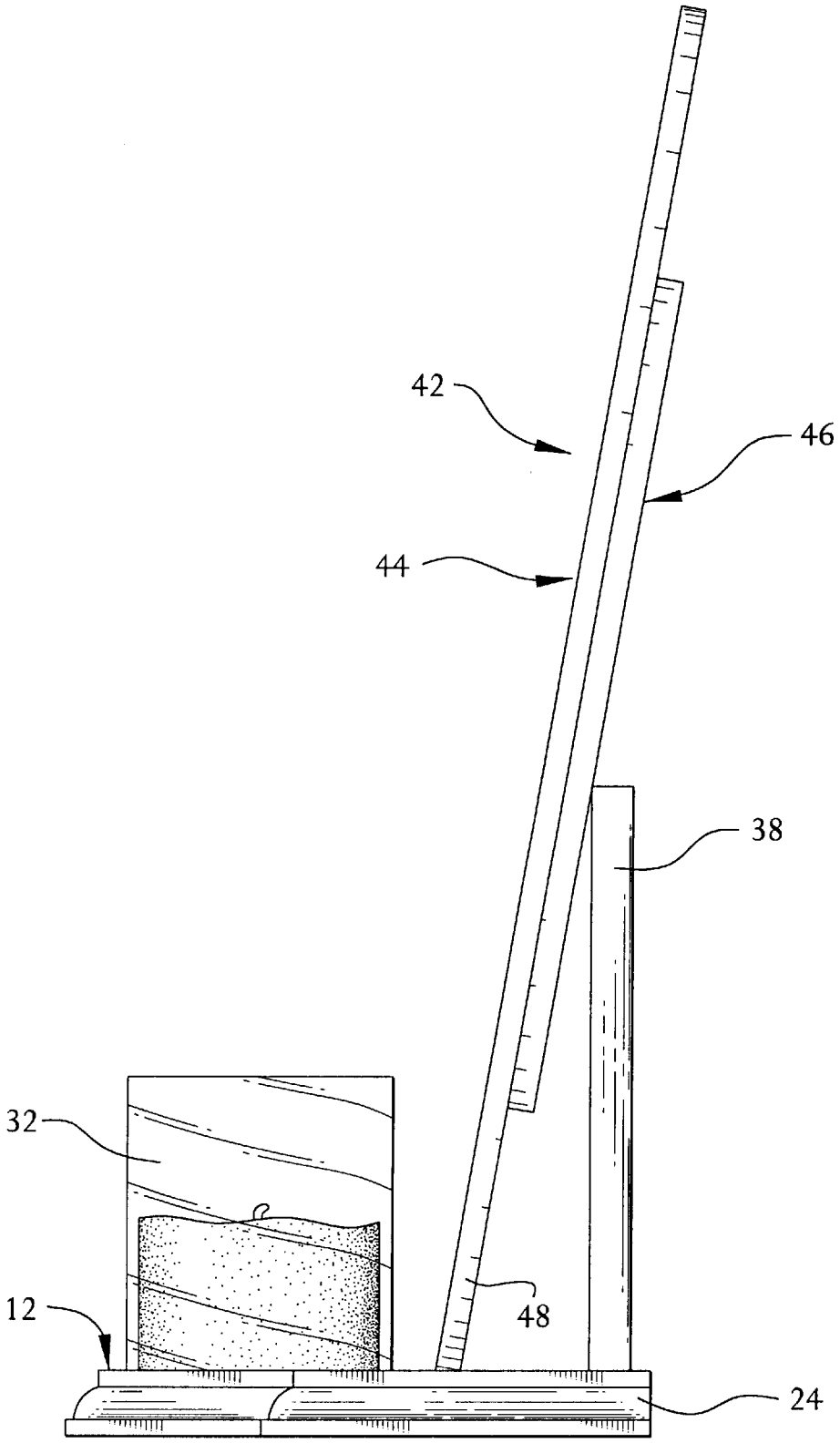
FIG. 4 is a side elevational view of the display of the present invention.
Figure 8:
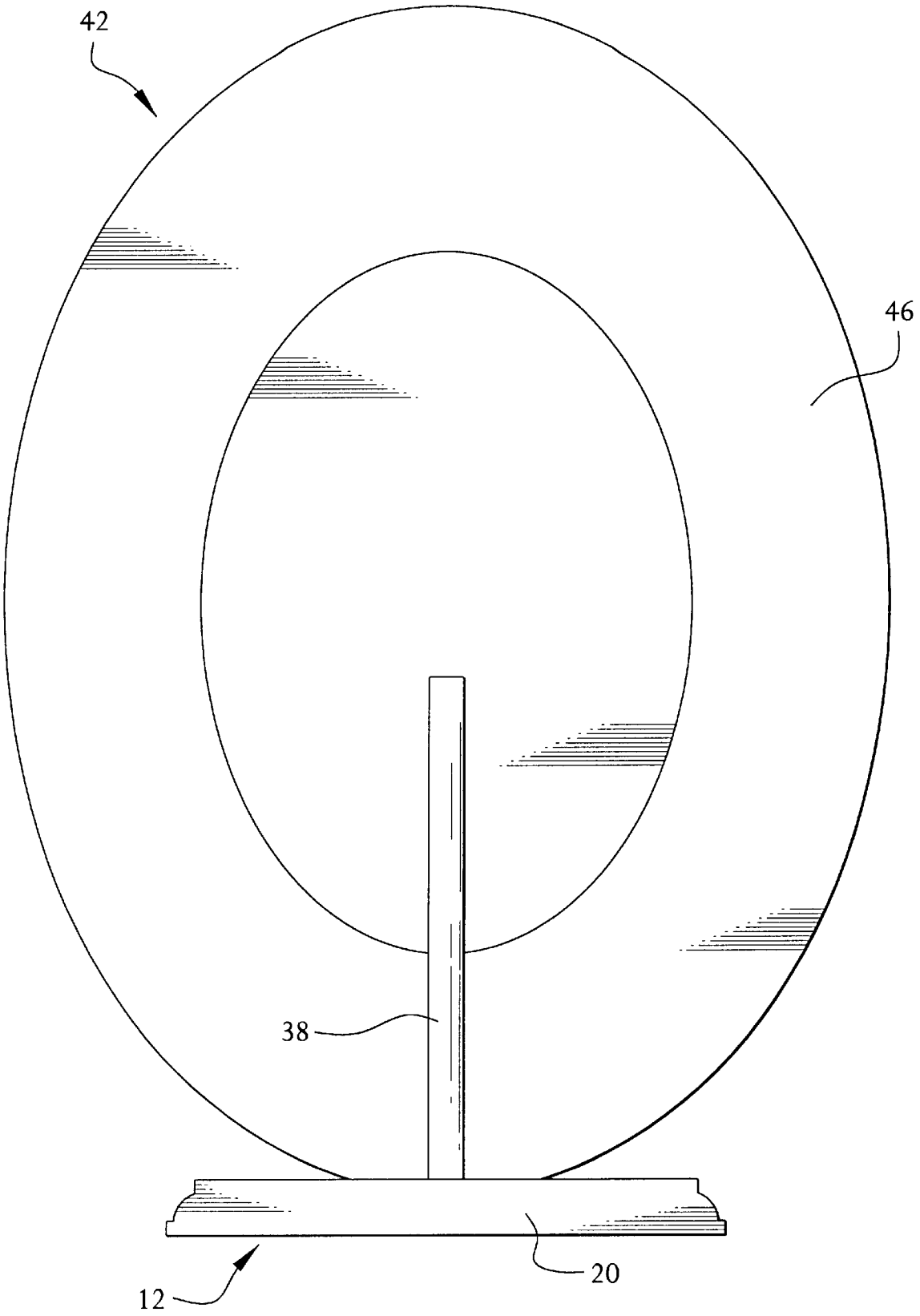
FIG. 8 is a rear elevational view of the display of the present invention.

As shown in FIG. 4, the plate 42 rests against the support post 38, forming an angle of inclination less than 90 degrees relative to the base 14. As shown in FIG. 8, the support post 38 supports the plate 42 at a point on the plate 42 approximately between one-half to one-third its vertical height. FIG. 6 shows the flat bottom surface 16 which provides ample support for a plate 42 having a width greater than the display base 12. The mass of the base 12 is contemplated to be great enough, in relation to the plate 42, to prevent the base from tipping over. As best shown in FIG. 7, the resulting orientation of the plate 42 permits the front face 44 to be viewed from the front end 18 of the base 12 and behind the candle 32 situated in the recess 30. The front face 44 of the plate 42 may have decorative features, such as that of religious symbols or the like.

Figure 9:
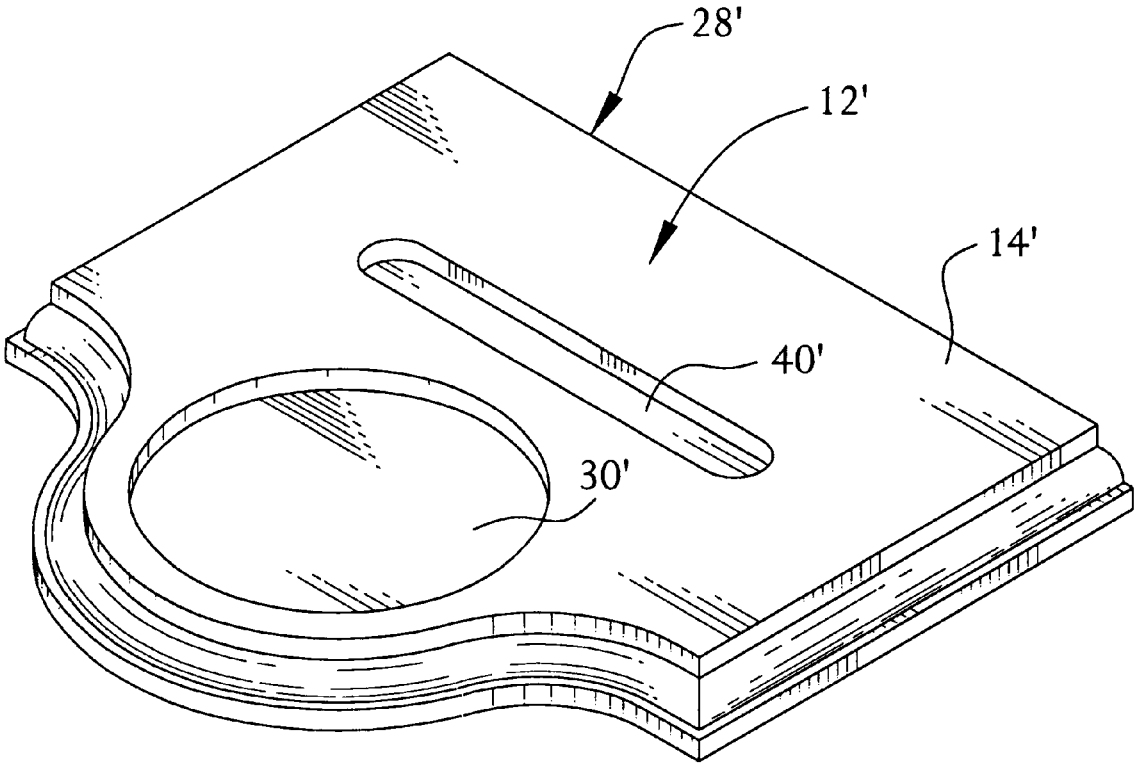
FIG. 9 is an isometric view of an alternative embodiment of a display base as contemplated by the present invention.

In an alternative embodiment, as shown in FIG. 9, the base 12' does not contain a support cavity nor a support post. The back edge 28' of the base 12' may be positioned against a wall (not shown in the drawings). A plate (not shown in the drawing) is supported by resting its edge in the groove 40' and allowing the back face of the plate to be rested against the wall. A plate may also be supported by the groove 40' alone.

The base and support post are preferably made of wood, but any material providing the structural integrity necessary to support the plate and candle is contemplated. The support post is secured to the base by conventional methods appropriate for the chosen materials. With the preferred use of wood, the support may be glued into the support cavity. Nails or screws may also be used to secure the support post to the base. The bottom surface of the base may also contain an applied layer (or isolated swatches) of felt (not shown in the drawings) or similar material in which to reduce the possibility of the base scratching a surface of a table or shelf upon which the display is placed. It is also contemplated that the display may be used to display small incandescent light or similar device in lieu of a candle. Moreover, a plant or other display article may be supported in the recess instead of a light source. The display is equally not limited to a plate or similar article, for the display base may support a photograph, award plaque or a similar article.

Although the present invention has been described in detail in connection with the above embodiments, it is to be understood that such detail is solely for that purpose and that variations can be made by those skilled in the art without departing from the spirit of the invention except as it may be limited by the following claims.

What is claimed is:

1. A decorative display comprising:

(a) a base having a top surface and an opposing bottom surface, and having a front end and an opposing back end;

(b) at least one recess located on the top surface of the base adjacent the front end and a cavity within the top surface of the base;

(c) a vessel positioned within the recess and projecting upwardly from the top surface of the base;

(d) a support post projecting from the top surface of the base and retained within the cavity;

(e) an elongated groove located on the top surface of the base, the groove having a depth less than the thickness of the base, the groove positioned adjacent but spaced from the support post;

(f) a plate having a decorative front face, a back face and a peripheral outer edge, a portion of the peripheral edge positioned within the groove on the top surface of the base, the back face supported by the support post, and the decorative front face directed toward the front end of the base.

2. A decorative display as claimed in claim 1, wherein the vessel is adapted to retain a candle.

3. A decorative display as claimed in claim 2, wherein the base has a line of symmetry extending from the front end to the back end.

4. A decorative display as claimed in claim 3, wherein the groove and support post are positioned along the line of symmetry.

5. A decorative display as claimed in claim 4, wherein the recess is also positioned along the line of symmetry.

6. A decorative display as claimed in claim 1, wherein the support post is cylindrical in cross section.

7. A decorative display as claimed in claim 1, wherein the cavity for retaining the support post has a depth which is less than the thickness of the base.

8. A decorative display as claimed in claim 1, wherein the recess is cylindrical.

9. A decorative display as claimed in claim 8, wherein the recess has a depth which is less than the thickness of the base and has a bottom surface which supports the vessel.

10. A decorative display comprising:

a base having a top surface and an opposing bottom surface, and having a front end and an opposing back end, the base has a line of symmetry extending from the front end to the back end;

at least one recess located on the top surface of the base adjacent the front end, the recess having a depth which is less than the thickness of the base and having a bottom surface;

a vessel for retaining a candle, the vessel positioned within the recess, supported on the bottom surface thereof and projecting upwardly from the top surface of the base;

a support post projecting from the top surface of the base, the support post retained within a cavity within the top surface of the base, the cavity for retaining the support post having a depth less than the thickness of the base;

an elongated groove located on the top surface of the base, the groove having a depth less than the thickness of the base and a width which is less that the width of the base, the groove positioned adjacent but spaced from the support post, the groove and support post positioned along the line of symmetry for the base;

a plate having a decorative front face, a back face and a peripheral outer edge, a portion of the peripheral edge positioned within the groove on the top surface of the base, the back face supported by the support post, and the decorative front face directed toward the front end of the base.

11. A decorative display as claimed in claim 10, wherein the recess is also positioned along the line of symmetry.

12. A decorative display as claimed in claim 10, wherein the support post is cylindrical in cross section.

13. A decorative display as claimed in claim 10, wherein the recess is cylindrical.

* * * * *